US006793554B1

(12) United States Patent
Newbold

(10) Patent No.: US 6,793,554 B1
(45) Date of Patent: Sep. 21, 2004

(54) FLEXIBLE WALL BOOSTER WHEEL FOR TOY VEHICLE TRACKSET

(75) Inventor: Roger Newbold, Garden Grove, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/611,293

(22) Filed: Jun. 30, 2003

Related U.S. Application Data

(60) Provisional application No. 60/443,448, filed on Jan. 28, 2003.

(51) Int. Cl.[7] ..... A63H 18/00
(52) U.S. Cl. ..... 446/429; 446/444
(58) Field of Search ..... 446/236, 429, 446/430, 431, 444, 448, 449, 465, 486; 104/168; 198/782

(56) References Cited

U.S. PATENT DOCUMENTS 3,559,335 A 2/1971 See
3,633,902 A 1/1972 Worden
3,636,651 A 1/1972 Lohr et al.
3,641,704 A 2/1972 Sims et al.
4,070,024 A 1/1978 Hamano
4,174,587 A 11/1979 Morin et al.
5,052,972 A 10/1991 Suimon et al.
5,067,413 A 11/1991 Kiuchi et al.
5,165,347 A 11/1992 Wagner
5,299,969 A 4/1994 Zaruba
5,402,730 A 4/1995 Salter et al.
5,643,036 A * 7/1997 Liu et al. ..... 446/23
5,899,789 A 5/1999 Rehkemper et al.
6,241,573 B1 6/2001 Ostendorff
6,435,929 B1 * 8/2002 Halford ..... 446/6

* cited by examiner

*Primary Examiner*—Jacob K. Ackun, Jr.
(74) *Attorney, Agent, or Firm*—Roy A. Ekstrand

(57) ABSTRACT

A toy vehicle booster for accelerating a toy vehicle upon a trackway includes a pair of rotating flexible resilient booster wheels positioned on each side of the trackway. In an alternative embodiment, a booster wheel is positioned above the trackway so as to engage the horizontal surfaces such as the roof of the toy vehicles. The booster wheels are formed of a concave resilient structure having a plurality of apertures positioned within the booster wheel to provide a desired flexibility in certain portions of the booster wheel.

6 Claims, 3 Drawing Sheets

20
21
10
22
11
40
50
16
51
30
52
3
41
31
3
14
15
42
32
12
13
23

FLEXIBLE WALL BOOSTER WHEEL FOR TOY VEHICLE TRACKSET

CROSS-REFERENCE TO RELATED PATENT APPLICATION

This application describes and claims subject matter disclosed in a provisional patent application filed Jan. 28, 2003 having Ser. No. 60/443,448 and entitled FLEXIBLE WALL BOOSTER WHEEL FOR TOY VEHICLE TRACKSET having the same applicant as the present application.

FIELD OF THE INVENTION

This invention relates generally to toy vehicle and particularly to boosters or accelerators which are utilized therein.

BACKGROUND OF THE INVENTION

A large number of toy vehicle tracksets or playsets which are produced by practitioners in the art comprise closed loops of track portions which allow continuous operation of one or more toy vehicles traversing the closed loop trackway. The toy vehicles used in such closed loop trackways may either be free-wheeling unpowered vehicles or vehicles which utilize an onboard power drive mechanism. In the use of unpowered vehicles on closed loop trackways, practitioners often provide devices for accelerating the toy vehicles upon the trackway. Such accelerating devices are known generally in the art as "boosters" and typically include one or more motordriven rotating wheels adjacent a portion of the trackway. As a vehicle passes through the portion of the trackway occupied by the booster, the rotating wheel temporarily engages the passing toy vehicle and imparts energy thereto. The most common type of booster utilized employs a pair of spaced apart wheels on either side of the toy vehicle travel path which operate in conjunction to engage the passing toy vehicle from both sides and impart energy and acceleration thereto.

Not surprisingly, a substantial importance is placed upon the structure of the rotating wheels used in such boosters. The most common type of booster wheels employ disc-shaped members formed of a resilient foam material or the like. The objective is to provide frictional engagement with the passing toy vehicle to an extent sufficient to allow the rotating wheel to accelerate the toy vehicle. A further objective of such booster wheels is the resilient deformation of the booster wheels to accommodate a variety of differently sized and shaped toy vehicles. For example, U.S. Pat. No. 3,636,651 issued to Lohr et al. sets forth a TOY VEHICLE PROPULSION UNIT operative upon a closed circuit trackway such that the toy vehicle traverses the trackway and passes through the propulsion unit during each circuit. The propulsion unit includes a motor drive coupled to a rotatable booster wheel supported above the travel path of the toy vehicle. The booster wheel includes a generally hemispherical flexible member which is rotated at high speed and which deforms to engage the upper surface of the toy vehicle as it passes through the booster or propulsion unit.

U.S. Pat. No. 5,052,972 issued to Suimon et al. sets forth a DRIVE DEVICE FOR TOY AUTOMOBILE having a booster section supported above a toy vehicle trackway. The booster section includes a rotating flexible wheel having a generally cylindrical shape which engages the upper surface of the toy vehicle passing through the booster unit.

U.S. Pat. No. 3,590,524 issued to Beny et al. sets forth a TOY VEHICLE ACCELERATOR having a pair of booster sections supported in a common housing. Each booster section includes a pair of generally cylindrical rotating resilient booster wheels which engage the sides of toy vehicles passing through either portion of the toy vehicle booster.

U.S. Pat. No. 3,559,335 issued to See sets forth a TOY VEHICLE ACCELERATION MECHANISM having a rotating booster wheel supported above or, in an alternate embodiment, along side the travel path of a toy vehicle. The rotating booster wheel engages the vehicle and accelerates it through the trackway.

U.S. Pat. No. 3,641,784 issued to Sims et al. sets forth an ACCELERATOR FOR A VEHICLE TOY utilized with unpowered freely rolling vehicles upon a trackway. The accelerator includes a motor drive and a pair of spaced apart gear coupled booster wheels which engage the toy vehicle passing through the booster station and accelerate the vehicle.

U.S. Pat. No. 4,070,024 issued to Hamano sets forth a CONTINUOUS RACETRACK HAVING VEHICLE ACCELERATING DEVICE utilized in a continuous racing game having a trackway provided with separate paths along which vehicles race. The accelerating device includes a plurality of resilient spokes associated with each of the paths. The spokes are mounted for rotation and are radially oriented such that the ends of the spokes extend into the paths and impart acceleration to the toy vehicles.

U.S. Pat. No. 4,174,587 issued to Morin et al. sets forth an AIR TURBIN OPERATED VEHICLE ACCELERATING TOY having a base with a roadway portion formed therein. The base defines opposed slots on each side of the roadway within which engaging rollers are rotatably mounted. An air pump is provided which operates tubin means coupled to the drive rollers.

U.S. Pat. No. 5,067,413 issued to Kiuchi et al. sets forth an APPARATUS FOR CONVEYING TRAVELABLE BODY in which traveling power is transmitted one of a plurality of travelable bodies which are positioned on at least one end of the alignment.

Additional examples of conventional booster apparatus for toy vehicles which impart acceleration thereto using one or more rotating resilient wheels are set forth in U.S. Pat. No. 5,165,347 issued to Wagner, U.S. Pat. No. 5,299,969 issued to Zaruba, U.S. Pat. No. 5,899,789 issued to Rehkemper et al., U.S. Pat. No. 6,241,573 issued to Ostendorff et al., and U.S. Pat. No. 3,633,902 issued to Worden. In a related art, U.S. Pat. No. 5,402,730 issued to Salter et al. sets forth a PLATEN DRIVE UNIT utilized in propelling platens of vehicles moving along a track. The drive unit may be readily used at any portion of the track because it acts as a castor about a kingpin assembly. This substantially reduces the effects of roller scrub on curved track portions.

SUMMARY OF THE INVENTION

Accordingly, it is a general object of the present invention to provide an improved booster for a toy vehicle trackset. It is a more particular object of the present invention to provide an improved booster wheel structure for use in toy vehicle boosters.

In accordance with the present invention, there is provided a resilient flexible booster wheel formed of a flexible thin-walled toroid segment which provides improved flexibility, frictional grip, and accelerating characteristics not found in the prior art booster wheels.

The present invention is implemented by a booster wheel for use in a toy vehicle booster, said booster wheel comprising: a flexible thin-walled member forming a concave generally cylindrical wheel having a side wall portion, a top wall portion and a curved portion therebetween; plate means secured to the top wall portion for coupling to a rotation source; and a plurality of flexibility altering apertures formed in the flexible thin-walled member, the flexibility altering apertures being sized and positioned to provide a desired resilient and flexibility characteristic for said booster wheel.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
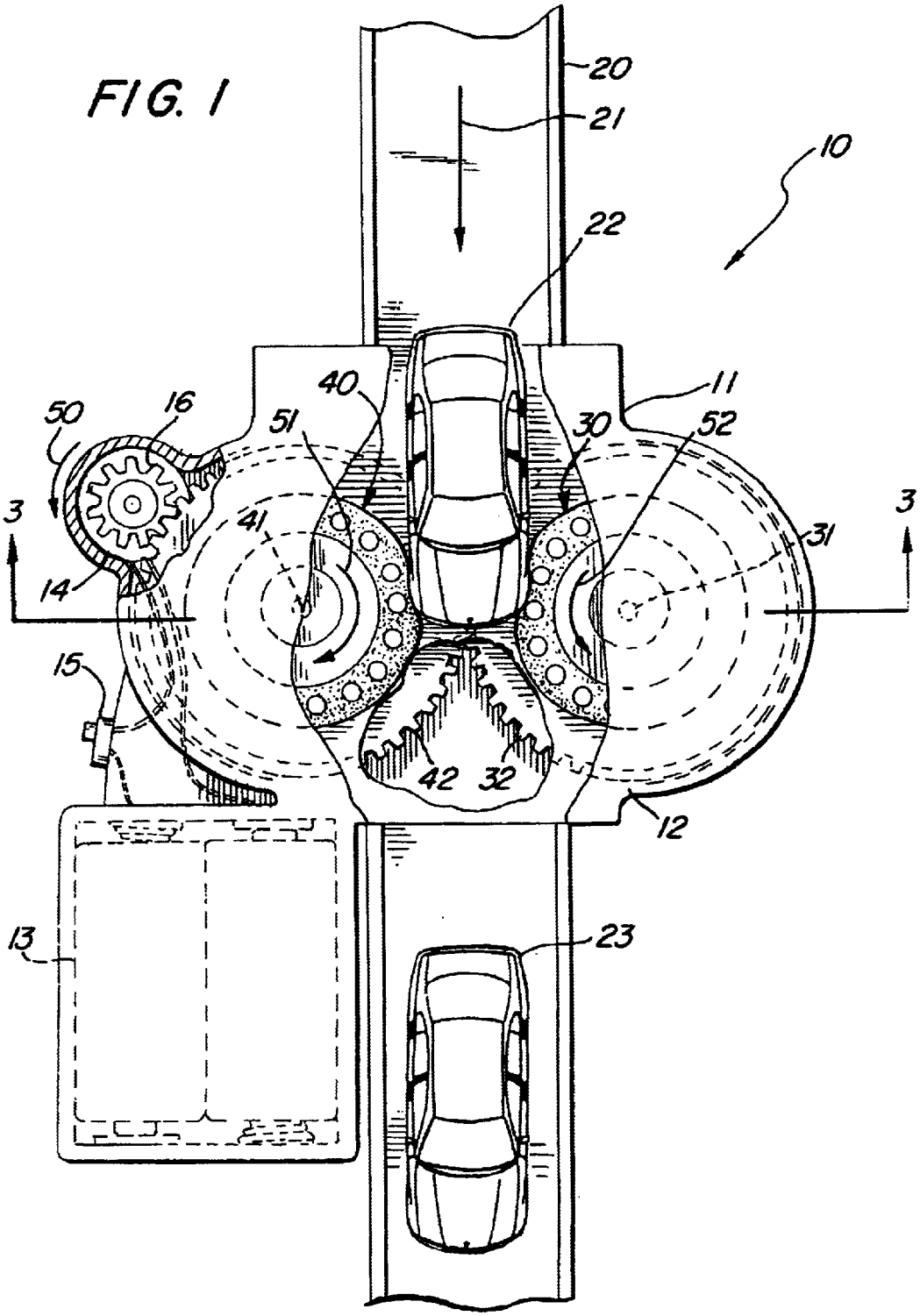
FIG. 1 sets forth a partially sectioned top view of a toy vehicle booster having booster wheels fabricated in accordance with the present invention operative upon a typical set of toy vehicles.

FIG. 1 sets forth a partially sectioned top view of a trackset booster generally referenced by numeral 10 operative in combination with a track portion 20 and a pair of typical toy vehicles 22 and 23. Trackset booster 10 includes a base 11 having an upper housing 12 together with a plurality of batteries 13 and a drive motor 14. An on/off switch 15 operatively couples motor 14 to batteries 13 in accordance with conventional fabrication techniques. Motor 14 further supports a drive gear 16 extending upwardly into the interior of housing 12. A pair of rotating shafts 31 and 41 are rotatably supported within base 11 and housing 12 by conventional means (seen in FIG. 3).

In accordance with the present invention, a pair of thin-walled flexible booster wheels 30 and 40 are rotatably supported within housing 12 upon shafts 31 and 41. Booster wheels 30 and 40 are respectively coupled to and rotatable with a pair of driven gears 32 and 42. Gears 32 and 42 mutually engage and are operatively coupled to their respective booster wheels 30 and 40 in the manner shown in FIG. 3. In addition, drive gear 16 of motor 14 operatively engages gear 42.

In operation as batteries 13 supply operative power to motor 14, drive gear 16 is rotated in the direction indicated by arrow 50. Correspondingly, the rotation of drive gear 16 causes gear 42 to rotate in the direction indicated by arrow 51 and further causes gear 32 to rotate in the direction indicated by arrow 52. The opposite direction rotations of booster wheels 30 and 40 provides the appropriate rotational direction for accelerating a toy vehicle entering the space therebetween.

In the depiction shown in FIG. 1, toy vehicle 22 traveling upon track 20 in the direction indicated by arrow 21 moves forwardly between booster wheels 30 and 40 which, as mentioned above, are oppositely rotating. The flexible thin-walled structure of booster wheels 30 and 40 allows toy vehicle 22 to engage and deform the flexible walls of both booster wheels. In this manner, booster wheels 30 and 40 cooperate to engage and, as they rotate, accelerate toy vehicle 22 through booster 10 toward the position shown by toy vehicle 23. In accordance with the present invention, the thin-walled flexible structure of booster wheels 30 and 40 provide an optimum size accommodation for different toy vehicle dimensions which simultaneously providing a maximum of energy transfer between the rapidly rotating booster wheels and the toy vehicle passing therethrough.

Figure 2:
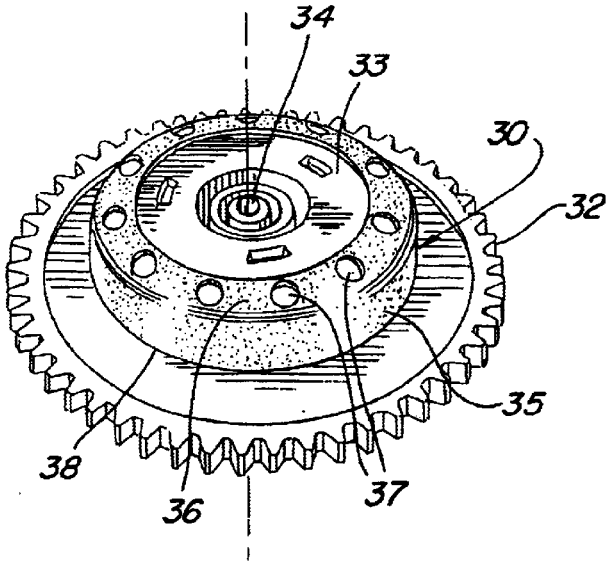
FIG. 2 sets forth a perspective view of a toy vehicle booster wheel constructed in accordance with the present invention.

FIG. 2 sets forth a perspective view of booster wheel 30 constructed in accordance with the present invention together with its supporting-driven gear 32. It will be understood by those skilled in the art that booster wheels 30 and 40 (seen in FIG. 1) are substantially identical. Thus, the depiction shown in FIG. 2 and the descriptions thereof which follow will be understood to apply equally well to booster wheel 40.

Figure 3:
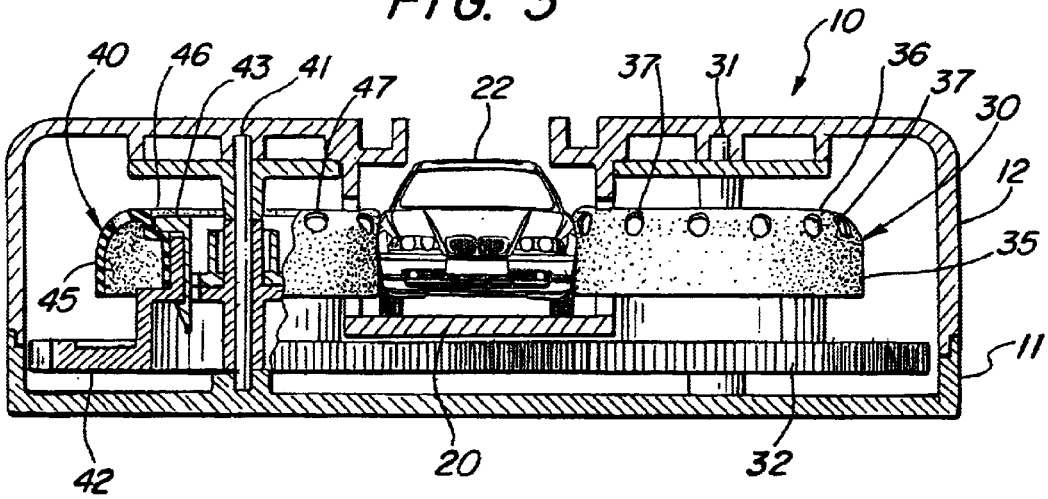
FIG. 3 sets forth a section view of the toy vehicle booster and cooperating toy vehicle shown in FIG. 1 taken along section lines 3—3 therein.

More specifically, booster wheel 30 which is formed of a flexible resilient material such as rubber or plastic or the like provides a substantially circular outer sidewall 35 together with a supporting top wall 36. Top wall 36 is operatively joined to a plate 33 which in turn defines a center bore 34. Sidewall 35 terminates at its lower end in an edge 38. As is best seen in FIG. 3, edge 38 is a free edge supported solely by resilient sidewall 35. Accordingly, the deformation of sidewall 35 and top wall 36 as a toy vehicle encounters the booster wheel set in the manner shown for example in FIG. 3 is unimpeded by any attachment to edge 38.

In accordance with an important aspect of the present invention, a plurality of apertures 37 are formed in top wall 36. It will be apparent to those skilled in the art that a substantial portion of the flexibility, resilience and gripping characteristics of booster wheel 30 for any given material may be controlled by selecting the size and spacing of apertures 37. Thus, the flexibility and deformation characteristics of sidewall 35 may be controlled to a substantial extent by controlling the characteristics of top wall 36 through selection of size and spacing of apertures 37. It will also be apparent to those skilled in the art that a variety of resilient flexible materials such as rubber or plastic or the like may be utilized in forming booster wheel 30. In further addition, it will be apparent that the gripping and deformation characteristics of booster wheel 30 may also be controlled to some extent by adjusting or selecting the thickness of sidewall 35 and top wall 36.

FIG. 3 sets forth a section view of trackset booster 10 taken along section lines 3—3 in FIG. 1. As described above, booster 10 includes a base 11 supporting a housing 12 which in turn defines a track 20 extending therethrough. A pair of booster wheels 30 and 40 are rotatably supported within housing 12 upon base 11 by a pair of shafts 31 and 41 respectively. Booster wheel 30 defines a flexible sidewall 35 and a flexible top wall 36. Booster wheel 30 further defines a plurality of apertures 37. Similarly, booster wheel 40 defines a flexible sidewall 45 and a top wall 46. Top wall 46 further defines a plurality of apertures 47. A plate 43 secures booster wheel 40 to a driven gear 42 to provide rotational coupling therebetween. A similar structure is provided for booster wheel 30 (seen for example in FIG. 2). A toy vehicle 22 is traveling upon track 20 between booster wheels 30 and 40. As can be seen, vehicle 22 is sufficient in width to exceed the spacing between booster wheels 30 and 40. As a result, flexible thin-walled booster wheels 30 and 40 are deformed against the opposite sides of vehicle 22. This deformation is controlled to a substantial extent by the novel thin-walled resilient structure of booster wheels 30 and 40. Apertures 37 and 47 in top walls 36 and 46 respectively cooperate to control or adjust the resiliency and deformation characteristics of booster wheels 30 and 40. As a result, an enhanced and improved gripping characteristic and energy transfer is provided by booster wheels 30 and 40 upon toy vehicle 22. In addition, it will apparent to those skilled in the art that the thin-walled flexible structure of booster wheels 30 and 40 accommodates a substantially greater width variation of toy vehicles passing through booster 10.

Figure 4:
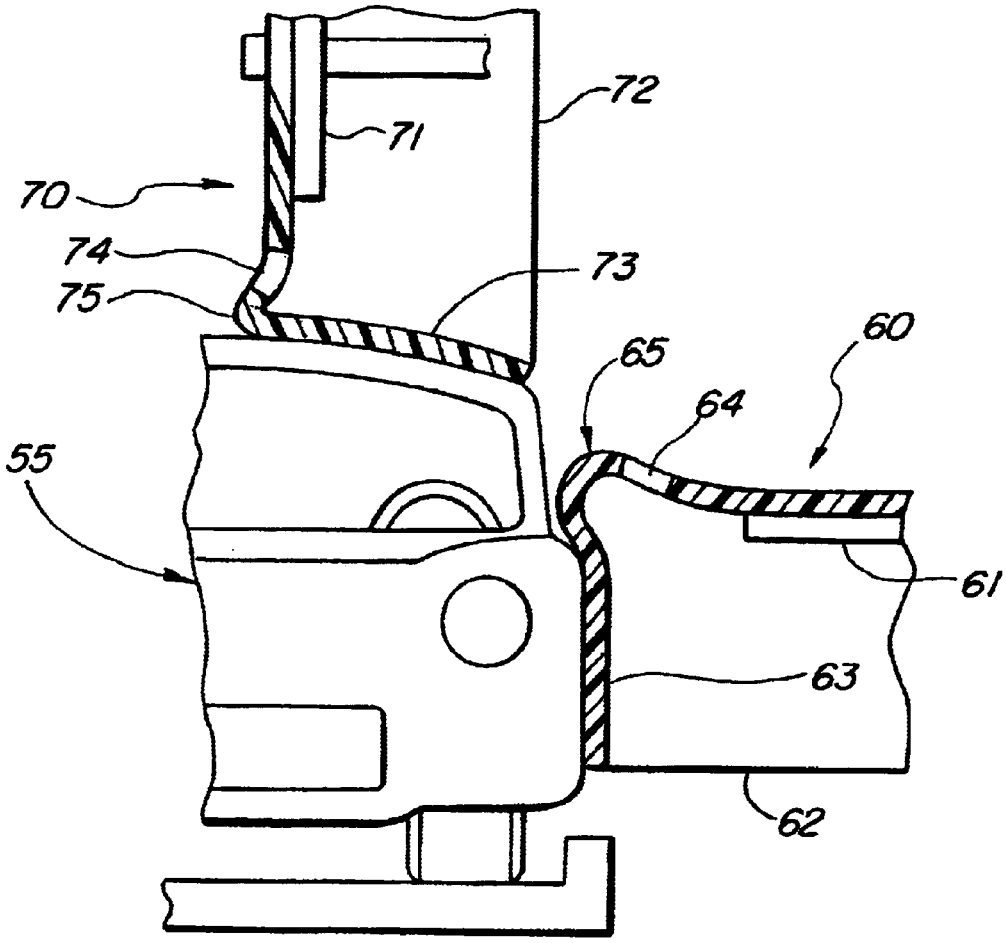
FIG. 4 sets forth a partial section view of a toy vehicle booster and cooperating toy vehicle showing the flexing characteristics of the booster wheel.

FIG. 4 sets forth a partial section view of an illustrative toy vehicle passing through a booster station having a pair of booster wheels 60 and 70 constructed in accordance with the present invention. Booster wheel 60 illustrates the above described horizontal application of the present invention booster wheel while booster wheel 70 illustrates and alternative positioning of booster wheel 70 to extend vertically and engage a horizontal surface such as the roof of a toy vehicle 55. The fabrications of booster wheels 60 and 70 are substantially identical to booster wheel 30 described above. Booster wheel 60 is driven by a hub 61 and includes a lower edge 62 and a concave skirt 63. A plurality of apertures 64 are formed upon booster wheel 60 to provide a controlled flexing of booster wheel 60 and to further establish the resilience and flexing characteristics of the booster wheel. As mentioned above, booster wheel 60 is preferably formed of a flexible material such as rubber or plastic and as a result exhibits a certain resilience and flexibility due to the nature of the material utilized. In addition however, and in accordance with an important aspect of the present invention, booster wheel 60 further defines a plurality of apertures such as aperture 64 which, in a similar fashion to booster wheel 30, are positioned about the entire outer portion of booster wheel 60. The size and location of apertures 64 establish increased flexibility in certain portions of booster wheel 60. Thus, materials which have a given flexibility or resilient may be controlled in their flex characteristic by the size location and number of apertures such as aperture 64. In the configuration shown in FIG. 4 in which booster wheel 60 is horizontally oriented and engages a vertical surface of toy vehicle 55, flex portion 65 forms as indicated in the approximate area of aperture 64 to allow skirt 63 to more substantially form to the side surface of vehicle 55. In this manner, a substantially greater friction and engagement is provided without increased pressure against the side of toy vehicle 55. The use of a flexible skirt 63 on booster wheel 60 greatly enhances this characteristic.

Booster wheel 70 is positioned to an alternative to booster wheel 60 to utilize the present invention booster wheel in a vertical alignment for engagement with a horizontal surface such as the roof of toy vehicle 55. Booster wheel 70 is in all respects fabricated and supported in substantially the same manner booster wheel 30 described above with the difference being found in the vertical orientation of booster wheel 70.

More specifically, booster wheel 70 includes a supporting hub 71 and a resilient skirt 73. Skirt 73 terminates in an edge 72. In accordance with the above described fabrication of the present invention, a plurality of apertures such as aperture 74 are formed about the outer portion of booster wheel 70 to impart a predetermined flexibility to the regions adjacent the apertures. In the example shown in FIG. 4, booster wheel 70 deforms or flexes to form a flex portion 75 allowing skirt 73 to conform to and frictionally engage the roof portion of toy vehicle 55.

It will be apparent to those skilled in the art that in accordance with an important aspect of the present invention, the number and size of apertures formed in the present invention booster wheels allows substantial control of the flexing characteristics of the booster wheel. In this manner, the present invention booster wheel is able to accommodate a substantial variation in vehicle size as well as vehicle shape while still effectively imparting acceleration thereto. It will be equally apparent to those skilled in the art that a substantial range of resilient materials such as rubber or plastic or the like may be utilized in forming the present invention booster wheels.

What has been shown is a novel toy vehicle booster having booster wheels formed of a thin-walled flexible material which provides unique deformation and gripping characteristics for the booster wheels. This in turn provides enhanced performance of the toy vehicle booster apparatus.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed:

1. A booster wheel for use in a toy vehicle booster, said booster wheel comprising:

a flexible thin-walled member forming a concave generally cylindrical wheel having a side wall portion, a top wall portion and a curved portion therebetween;

plate means secured to said top wall portion for coupling to a rotation source; and a plurality of flexibility altering apertures formed in said flexible thin-walled member, said flexibility altering apertures being sized and positioned to provide a desired resilience and flexibility characteristic for said booster wheel.

2. The booster wheel set forth in claim 1 wherein said flexible thin-walled member defines an edge formed on said skirt portion.

3. The booster wheel set forth in claim 2 wherein said flexibility altering apertures are formed in said top wall portion.

4. The booster wheel set forth in claim 2 wherein said flexibility altering apertures are formed in said curved portion.

5. The booster wheel set forth in claim 2 wherein said flexible thin-walled member is formed of rubber.

6. The booster wheel set forth in claim 2 wherein said flexible thin-walled member is formed of plastic.

* * * * *